US006604728B1

(12) United States Patent
Boydon

(10) Patent No.: US 6,604,728 B1
(45) Date of Patent: Aug. 12, 2003

(54) MULTIPLE USE HAMMER

(76) Inventor: Kevin Boydon, 49630 Compass Pt., New Baltimore, MI (US) 48047

( * ) Notice: Subject to any disclaimer, the term of this patent is extended or adjusted under 35 U.S.C. 154(b) by 0 days.

(21) Appl. No.: 10/153,532

(22) Filed: May 21, 2002

Related U.S. Application Data

(63) Continuation-in-part of application No. 09/881,364, filed on Jun. 14, 2001.

(51) Int. Cl.[7] ..... B25C 11/00
(52) U.S. Cl. ..... 254/25; 254/26 R; 81/20
(58) Field of Search ..... 254/25, 26 R, 254/26 F, 27; 81/23, 26, 25, 20; 224/904

(56) References Cited

U.S. PATENT DOCUMENTS

D45,761 S * 5/1914 Miller ..... 254/25
1,314,247 A * 8/1919 Clendenen ..... 254/25
1,773,931 A * 8/1930 Ayvad ..... 254/25
1,915,892 A * 6/1933 Keizer ..... 254/25
2,186,333 A * 1/1940 Giersch ..... 254/25
2,272,362 A * 2/1942 Barker ..... 254/25
3,522,932 A * 8/1970 Nakasone ..... 254/25
3,599,255 A * 8/1971 Carroll, Sr. ..... 254/25
5,027,677 A * 7/1991 Rallo ..... 254/25
5,213,023 A * 5/1993 Floyd ..... 254/25
5,490,437 A * 2/1996 Hebert et al. ..... 81/22
6,131,488 A * 10/2000 Coonrad ..... 254/25

* cited by examiner

*Primary Examiner*—Lee D. Wilson
(74) *Attorney, Agent, or Firm*—John R. Benefiel

(57) ABSTRACT

A multiuse hammer having multiple pry features of varying configurations as well as a striking face on an enlarged head portion. One feature is formed on the handle end, another long length straight but angled claw on the head portion, and a pry tooth projects to one side of the claw.

9 Claims, 2 Drawing Sheets

MULTIPLE USE HAMMER

CROSS REFERENCE TO RELATED APPLICATION

This application is a continuation-in-part of U.S. Ser. No. 09/881,364, filed Jun. 14, 2001.

BACKGROUND OF THE INVENTION

This invention concerns hammers and more particularly hammers suited for multiple use as by a roofer in carrying out nailing, striking, prying and/or nail removal tasks of the type typically encountered when roofing.

A standard carpenter's hammer has a curving claw projecting back from the striking face. Such a standard claw is often awkward to use for prying, as the handle must be tilted forward, and forward clearance is sometimes not available. The hammer head configuration does not create a great deal of leverage, such that excessive effort is required, even for extracting nails.

Further, the standard hammer claw is not well suited to a variety of prying applications encountered by a roofer, as when inserting the same under shingles, trim, flashing, siding, etc., and a roofer usually must carry other pry tools in addition to a hammer.

Another roofer need is convenience in carrying the hammer, as the roofer is usually working on his knees or stooped over, such that a belt holder makes removing the hammer awkward or necessitates standing up. Since a roofer must use his hammer frequently, even a slight hindrance is burdensome over the course of a work day.

It is now the usual practice to use a nailing gun for nailing the shingles, and a person usually would prefer to reach for a holstered nailing gun with the same hand as he reaches for a hammer.

It has heretofore been proposed to provide a leg holster for hammers as shown in U.S. Pat. No. 5,605,263, but that holster is complex and costly as it has a number of mechanical parts, and some effort is required in seating the hammer in the holder.

It is an object of the present invention to provide a hammer having multiple pry and extraction features which are configured to be particularly effective for roofers for striking as well as prying tasks.

It is another object to provide a hammer which can be held in simple and convenient belt loop holder.

SUMMARY OF THE INVENTION

The above recited objects and others which will be understood upon a reading of the following specification and claims are achieved by a tool comprising a hammer having multiple pry features. The hammer is preferably of one piece metal construction including an extra heavy striking head shaped as an elongated straight bar, having an integral tubular handle attached at one end to the head at a location intermediate the length thereof and formed at its free end with slightly angled chisel prongs separated with a V-shaped slot. A bulging shape of the handle end together with a slight angling of the prongs allows a powerful mechanical advantage to be developed when grasping the head and using the handle length for leverage. The slight angle of the prongs allow the handle to extend away from a nail or shingle at a shallow angle to allow easy, convenient prying and extraction.

An extraction claw is also provided on one end of a head portion, which is of longer length than standard hammers, and which is flattened and extends from an angled surface of the striking head end to allow great leverage when prying or extracting a nail by a downward push on the handle to pull the nail partially out. This makes it easier to pull the nail the rest of the way out by pulling up on the handle in the conventional manner.

A pry tooth is also provided projecting from the outer side of at least one prong of the claw, which is upturned slightly to be effectively engageable with a vertical siding piece to slightly pry the same away from a vertical wall adjacent a roof surface by a force exerted with the tool handle.

This feature is useful to loosen siding to allow roof flashing to be inserted under the siding.

The hammer is also designed to be held in a simple belt loop holster. The head has sloping sides with a chamfer along the lower edges to be easily pulled past a nailer gun without catching. A pair of scallop features receive the belt holder strap, and a pair of integral webs each extending from the head to the handle locate and stabilize the hammer in the belt loop holder.

The webs also serve to increase the mass of the large head for increased striking power.

The scallop closer to the striking face is larger to function as a finger grip when extracting the hammer from the belt loop holder.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
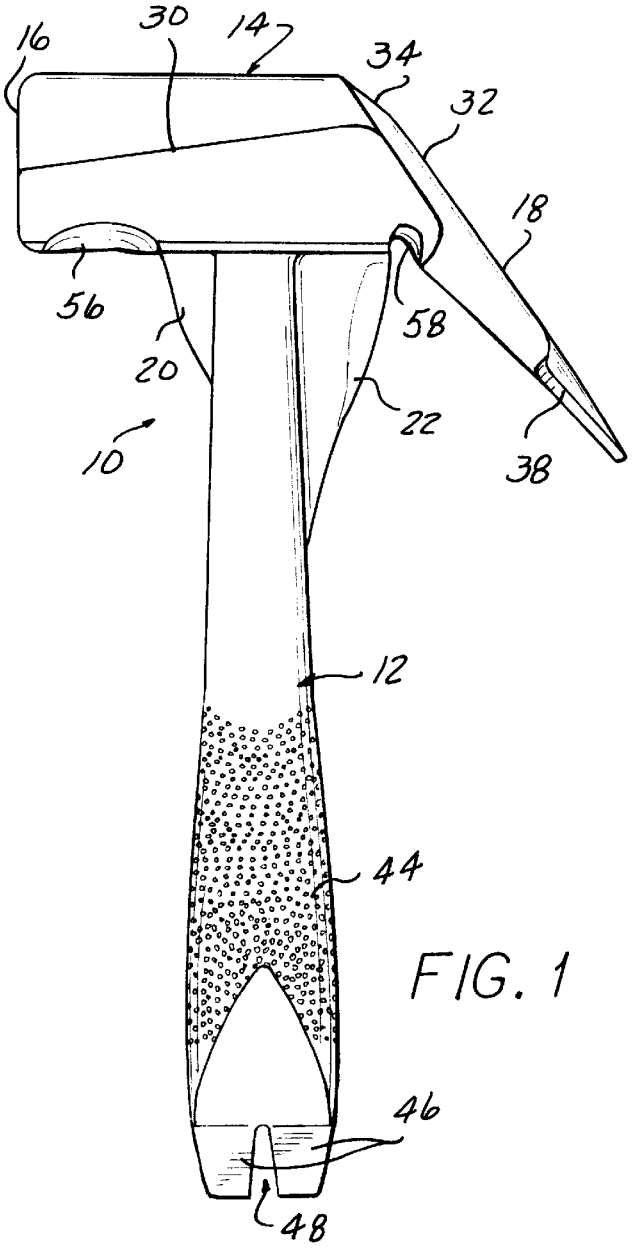
FIG. 1 is a front view of the multiple use hammer according to the invention, inserted in a holder according to the invention.

Referring to the drawings and particularly FIG. 1, the roofer's hammer 10 is shown, preferably of one piece construction and of forged steel, with a handle 12 formed integrally with a straight bar shaped head 14. The handle 12 is joined to the head 14 at an intermediate location along the length of the head 14. The handle 12 is preferably formed by a hollow tube, as seen in FIGS. 2, 3, 4 and 6 to minimize shock when using the hammer as a striking tool.

The head 14 has a flat striking face 16 at one end thereof, and a straight, relatively long extraction claw 18 downwardly extending from the other end. A pair of webs 20, 22 are provided each extending between the handle 12 and head 14 which also insure a centered retention in a conventional belt loop holder 24, shown in FIG. 6.

The elongated bar shaped head 14 has sloping sides 26, 28 (FIG. 2) angling in from a parting line 30 to present a trim contour to enable easy withdrawal from the holder 24 and clearance to minimize interference with a holstered nailer gun (not shown).

The head 14 has an opposite face 32 angled down and blending into the elongated tapered thickness extraction claw 28 extending outwardly and downwardly from the opposite face 32. An angled corner 34 provides an effective fulcrum point.

A V-shaped slot 36 (FIG. 3) is formed into the end of the extraction claw 18. The corner 34 of the angled face 38 forms a fulcrum point when using the claw 18 for completing nail extraction or prying. The long length and flat configuration of the claw 18 makes it effective as a pry for loosening shingles without breakage. The claw 18 can also be used effectively to punch a hole in plywood, siding, etc., and is designed to be sufficiently sturdy for that purpose.

A pry tooth feature 38 projects laterally from one prong of the claw 18 adjacent the end thereof.

Figure 2:
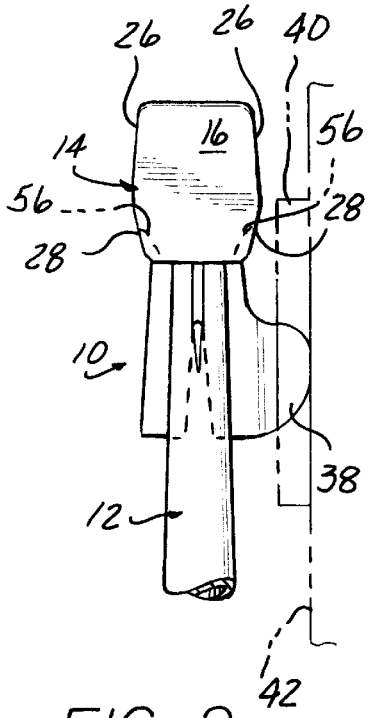
FIG. 2 is a fragmentary end view of the hammer shown in FIG. 1, showing the pry tooth with siding shown in phantom lines.
Figure 3:
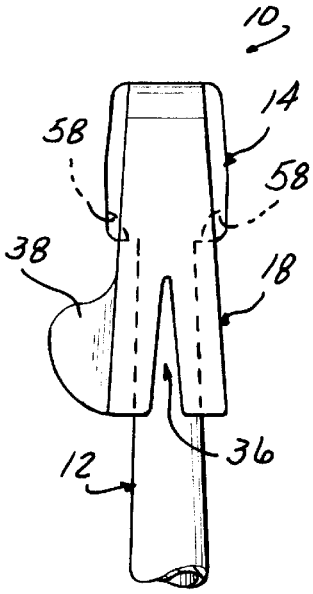
FIG. 3 is a fragmentary reverse end view of the roofer's hammer shown in FIG. 2.
Figure 4:
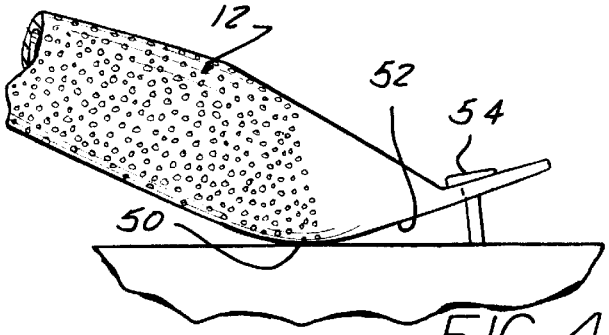
FIG. 4 is an enlarged side view of the lower end of the hammer handle, shown engaging a nail being extracted.

As seen in FIG. 2, the pry tooth feature 38 is angled up slightly to be effective in loosening siding 40 on a vertical wall 42 intersecting a roof 60. With the hammer 10 angled slightly away from the wall 42, and with the handle 12 extending alongside the wall 42, the feature 38 can be engaged with the bottom edge of the siding 40. When the handle 12 is pulled to the side, with the head 14 engaging the roof surface, the pry tooth feature 38 exerts a pry force on the siding, enabling it to be loosened. This allows flashing pieces to be inserted under the siding 40.

Figure 6:
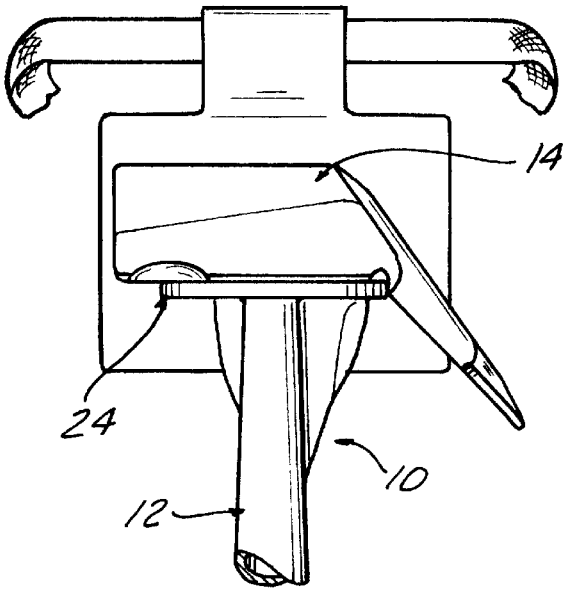
FIG. 6 is a fragmentary front view of the multiple use hammer in a belt loop holder.

The handle 12 has a knurling or dimple pattern 44 for a secure grip is formed with a pair of pry-extraction prongs 46 separated by a V-shaped slot 48 on the lower end of the handle 12. The prongs 46 are integral with the handle end and are angled out slightly from the handle axis (FIG. 6). The handle 12 has a bulge 50 at the end adjacent an inclined face 52 blending into the prongs 46. The bulge 50 creates a fulcrum when prying using the prongs 46, or when extracting a nail 54. Since the entire length of the handle 12 is available as a lever arm acting on the short distance from the bulge 50 to the slot 48, considerable force can be exerted. This pry feature comprised of the prongs 46 can more easily be used in many situations than a standard hammer claw, and allows the engagement of the user's knee to apply a force to the handle 12.

Figure 5:
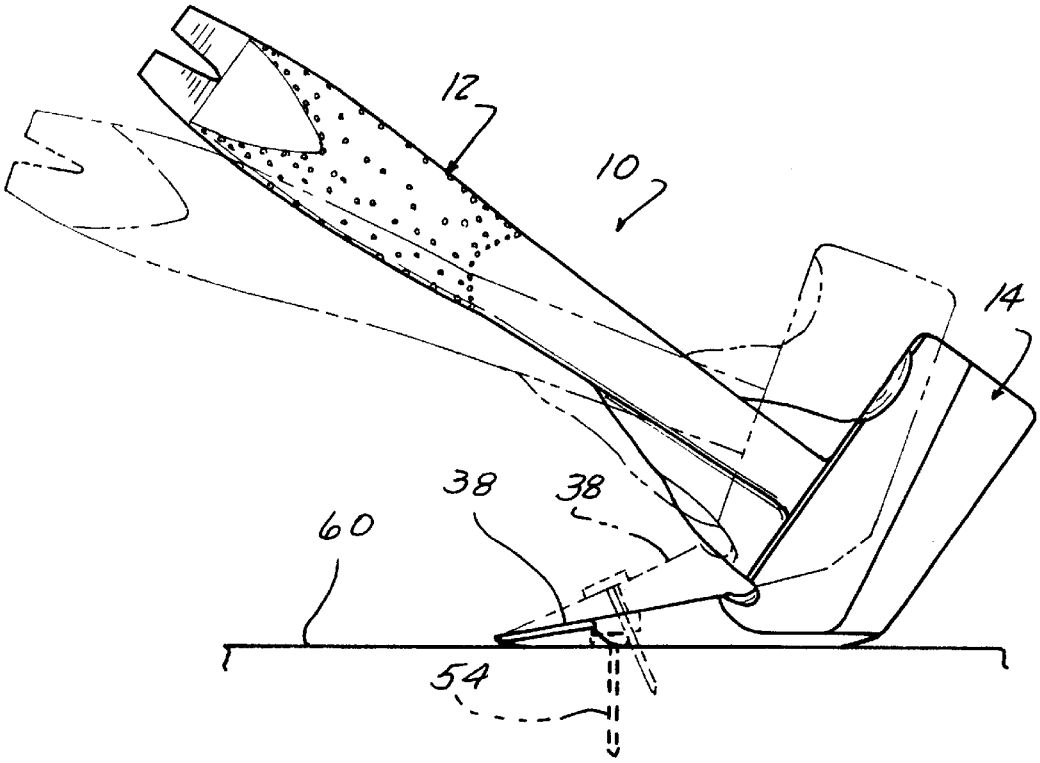
FIG. 5 is a side view of the hammer shown in FIG. 1 depicting the start of a nail extraction, the hammer handle pushed down as shown in phantom lines.

The head 14 is also formed with a large finger grip scallop 56 on each side at one end, and a smaller scallop 58 on each side at the other end, webs 20, 22 blending into a respective scallop 56, 58 as shown. This allows the head 14 to receive the belt loop holder 24 and be located therein. The larger scallop 56 provide easier gripping when removing the hammer from the belt holder 24 (FIG. 6). The length and straightness of extraction claw 18 allow it to be used to advantage when removing nails, as seen in FIG. 5. The nail extraction is started by pushing down on the handle 12, a much quicker motion, which exerts a powerful upward pull on the nail 54 as indicated. The handle 12 can then be pulled up to complete extraction, as necessary.

What is claimed is:

1. A hammer comprising:

an elongated handle;

a straight elongated bar shaped head connected to one end of said handle at an intermediate point along the length of said head, said head having a striking face defined on one end of said head;

a long straight extraction claw integrally formed on said head on an other end thereof opposite said one end having said striking face, said extraction claw extending downwardly and outwardly from said other end of said head, a V-shaped slot formed extending in from an outer edge of said extraction claw;

an outwardly angled pry tooth pointed and projecting away from a side of said claw at a distal end thereof in a lateral direction with respect to said side of said claw.

2. The hammer according to claim 1 wherein said head other end thereof has a sloping end face blending into said claw, said sloping end face forming a corner with a top surface of said head, said corner defining a fulcrum for said extraction claw.

3. A hammer according to claim 1 further including a web formed between said head and one side of an upper portion of said handle.

4. A hammer according to claim 3 wherein an additional web is formed extending between said head and an upper portion of said handle on another side of said upper portion of said handle.

5. The hammer according to claim 4 further including a pair of scallops formed into a lower side of said head on respective sides of said handle each scallop located adjacent a respective web, said scallops and webs facilitating centered retention in a belt loop holder encircling said handle.

6. The hammer according to claim 1 wherein said bar shaped head has tapering sides extending out from top and bottom sides thereof.

7. The hammer according to claim 1 wherein said handle is comprised of a hollow metal tube integrally formed with said head.

8. The hammer according to claim 1 wherein said handle has a chisel pry edge formed on an end portion opposite said head, said end portion inclined slightly out from a longitudinal axis of said handle;

an inclined end face on said handle end portion blending into said pry feature; said handle end portion having an enlarged portion closely spaced from said pry feature to form a fulcrum.

9. The hammer according to claim 8 wherein said chisel pry edge has a V-shaped slot extending thereinto.

* * * * *